US008297074B2

(12) United States Patent
Spreemann et al.

(10) Patent No.: US 8,297,074 B2
(45) Date of Patent: Oct. 30, 2012

(54) COILED HEAT EXCHANGER HAVING DIFFERENT MATERIALS

(75) Inventors: Juergen Spreemann, Rosenheim (DE); Manfred Schoenberger, Tacherting (DE); Christoph Seeholzer, Tacherting (DE); Eberhard Kaupp, Dorfen (DE); Stefan Bauer, Altenmarkt (DE)

(73) Assignee: Linde Aktiengesellschaft, Munich (DE)

( * ) Notice: Subject to any disclaimer, the term of this patent is extended or adjusted under 35 U.S.C. 154(b) by 867 days.

(21) Appl. No.: 11/997,281

(22) PCT Filed: Jul. 6, 2006

(86) PCT No.: PCT/EP2006/006625

§ 371 (c)(1),
(2), (4) Date: Aug. 11, 2008

(87) PCT Pub. No.: WO2007/014617

PCT Pub. Date: Feb. 8, 2007

(65) Prior Publication Data

US 2010/0005833 A1 Jan. 14, 2010

(30) Foreign Application Priority Data

Jul. 29, 2005 (DE) ..... 10 2005 036 413

(51) Int. Cl.
*F25J 1/00* (2006.01)
*F28D 7/02* (2006.01)
*F28F 21/00* (2006.01)

(52) U.S. Cl. ..... 62/614; 165/133; 165/163; 165/180

(58) Field of Classification Search ..... 62/614; 165/76, 133, 134.1, 163, 180; 29/890.054
See application file for complete search history.

(56) References Cited

U.S. PATENT DOCUMENTS

| | | | | |
|---|---|---|---|---|
| 3,788,281 | A * | 1/1974 | Van Lookeren Campagne | 122/7 R |
| 3,880,232 | A | 4/1975 | Parker | |
| 4,023,557 | A * | 5/1977 | Thorne et al. | 126/677 |
| 4,313,491 | A * | 2/1982 | Molitor | 165/83 |
| 5,131,351 | A | 7/1992 | Farina | |
| 5,651,269 | A | 7/1997 | Prevost et al. | |
| 6,095,240 | A * | 8/2000 | Hassanein et al. | 165/141 |
| 6,840,309 | B2 | 1/2005 | Wilson et al. | |
| 6,886,629 | B2 * | 5/2005 | Dietrich | 165/166 |
| 7,878,233 | B2 * | 2/2011 | Bates et al. | 165/153 |

FOREIGN PATENT DOCUMENTS

DE 1 501 519 A 6/1969

(Continued)

OTHER PUBLICATIONS

Pending Patent Application, titled "Coiled Heat Exchanger Having Different Tube Diameters", Inventors Manfred Steinbauer, et al., filed Jan. 29, 2008.

(Continued)

*Primary Examiner* — Allen Flanigan
*Assistant Examiner* — Indrajit Ghosh
(74) *Attorney, Agent, or Firm* — Crowell & Moring LLP

(57) ABSTRACT

A coiled heat exchanger having a plurality of tubes which are wound around a core tube is disclosed. The coiled heat exchanger having a casing which delimits an outer space around the tubes, and wherein a first and a second component of the coiled heat exchanger are composed of different materials.

7 Claims, 1 Drawing Sheet

FOREIGN PATENT DOCUMENTS

| | | | |
|---|---|---|---|
| DE | 1 912 341 | A | 9/1970 |
| DE | 195 17 114 | A | 10/1996 |
| DE | 197 07 475 | A | 8/1998 |
| DE | 198 48 280 | A | 4/2000 |
| EP | 1 314 947 | A2 | 5/2003 |
| EP | 1 367 350 | A1 | 12/2003 |
| FR | 2 797 943 | | 3/2001 |

OTHER PUBLICATIONS

Hausen/Linde, Tieftemperaturtechnik (Cryogenic Engineering), 2nd ed., 1985, pp. 471-475.

W. Scholz, "Coiled Tubular Heat Exchangers," Linde Reports on Science and Technology, No. 18 (1973), pp. 35-40.

W. Bach, "Offshore Liquefaction of Natural Gas with Liquid Nitrogen—Process Design and Comparison of Spiral-tube and Plate-fin Heat Exchangers," Linde Reports on Science and Technology, No. 47 (1990), pp. 31-37.

W. Förg et al., "A New LNG Baseload Process and Manufacturing of the Main Heat Exchanger," Linde Reports on Science and Technology, No. 61 (1999), pp. 3-11.

* cited by examiner

COILED HEAT EXCHANGER HAVING DIFFERENT MATERIALS

This application claims the priority of International Application No. PCT/EP2006/006625, filed Jul. 6, 2006, and German Patent Document No. 10 2005 036 413.6, filed Jul. 29, 2005, the disclosures of which are expressly incorporated by reference herein.

BACKGROUND AND SUMMARY OF THE INVENTION

The invention relates to a coiled heat exchanger having a plurality of tubes which are wound around a core tube, having a casing which delimits an outer space around the tubes.

Natural gas is continuously liquefied in large quantities in LNG baseload systems. Most of the time, liquefaction of the natural gas is accomplished by heat exchange with a coolant in coiled heat exchangers. However, many other applications of coiled heat exchangers are also known.

In a coiled heat exchanger, several layers of tubes are spirally wound on a core tube. A first medium is piped through the inside of at least one portion of the tubes, and this medium exchanges heat with a second medium flowing in the outer space between the tubes and a surrounding casing. The tubes are merged into several groups on the upper ends of the heat exchanger and fed out of the outer space in a bundled manner.

These types of coiled heat exchangers and their application, for example for liquefaction of natural gas, are described in each of the following publications:

- Hausen/Linde, Cryogenic Engineering, 2$^{nd}$ ed., 1985, pages 471-475;
- W. Scholz, "Coiled Tube Heat Exchangers," Linde Reports on Science and Technology, No. 33 (1973), pages 34-39;
- W. Bach, "Offshore Natural Gas Liquefaction with Nitrogen Cold—Process Design and Comparison of Coiled Tube and Plate Heat Exchangers," Linde Reports on Science and Technology, No. 64 (1990), pages 31-37;
- W. Förg et al., "A New LNG Baseload Process and Manufacturing of the Main Heat Exchanger," Linde Reports on Science and Technology, No. 78 (1999), pages 3-11 (English version: W. Förg et al., "A New LNG Baseload Process and Manufacturing of the Main Heat Exchanger," Linde Reports on Science and Technology, No. 61 (1999), pages 3-11);
- DE 1501519 A;
- DE 1912341 A;
- DE 19517114 A;
- DE 19707475 A; and
- DE 19848280 A.

Manufacturing coiled heat exchangers either of aluminum or of steel (stainless steel or special low-temperature steel) is known.

The invention is based on the objective of manufacturing these types of coiled heat exchangers more cost efficiently and/or improving its process engineering properties.

This objective is attained in that a first and a second component of the coiled heat exchanger are composed of different materials.

Until now this was intentionally refrained from for manufacturing-related reasons. On the contrary, attempts were made to use a uniform material for all components of the coiled heat exchanger in order to be able to connect them to one another more easily, particularly by welded joints.

The invention is now diverging from this principle and different materials are being used in the same heat exchanger.

As a result, the design of the heat exchanger can be optimized further, for example, with respect to volume, weight, strength and/or cost.

In this connection, the first and the second component can each be formed of the following components:

- Core tube, on which the tubes are coiled;
- Tubes;
- Sections of tubes;
- Tube bases (tube collectors);
- Casing, which closes the heat exchanger as a pressure vessel to the outside;
- Distributor for liquid and/or gas in the outer space of the tubes;
- Connecting pieces between two tube layers (spacers);
- Support arms to mount the connecting pieces; and
- Shroud, which is arranged between the casing and the tubes.

For example, the casing can be manufactured of steel and the tube bundle(s) can be manufactured of aluminum.

In this case, for example, a first component can be made of aluminum and the second component of steel. Aluminum should be understood here as both pure aluminum as well as every technically useable aluminum alloy, for example with an aluminum content of 50% or more, preferably with an aluminum content of 80% or more. Steel should be understood here as all types of steel, for example austenitic, ferritic, duplex steel, stainless steel and nickel steel.

In a concrete example, the first component can include a group of tubes in a first tube layer and be manufactured of aluminum; a second component can, for example, include another group of tubes of the same or another tube layer and be comprised of steel.

If the first and second components are connected with the same connecting piece, the connecting piece is made preferably of the material of the first component as a basic material and features a plating made of the material of the second component. Thus, the connecting piece can be welded to both the first component as well as to the second component. In a concrete example, aluminum tubes are welded to a tube base of stainless steel that has an aluminum plating.

In addition, the invention relates to the application of this type of heat exchanger for executing an indirect heat exchange between a hydrocarbonaceous stream and at least one heat fluid or cold fluid.

The hydrocarbonaceous stream in this case is formed by natural gas for example.

The hydrocarbonaceous stream is liquefied, cooled, heated and/or vaporized during the indirect heat exchange. The heat exchanger is preferably used for natural gas liquefaction or natural gas vaporization.

Normally, coiled heat exchangers made of aluminum are used for natural gas liquefaction. Alternatively, those made of steel can also be used for natural gas liquefaction.

DETAILED DESCRIPTION OF THE DRAWING

Figure 1:
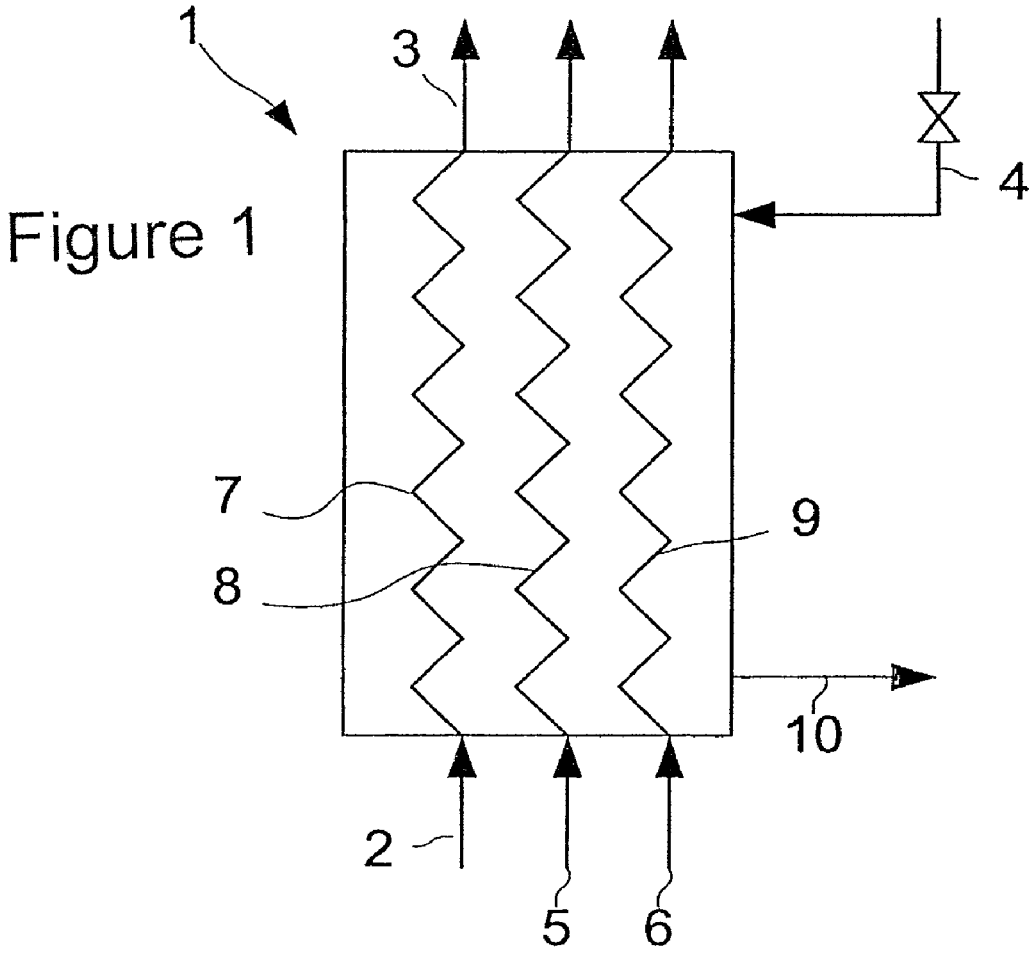
FIG. 1 illustrates an embodiment of a coiled heat exchanger in accordance with the principles of the present invention.

The invention and additional details of the invention are explained in greater detail in the following on the basis of an exemplary embodiment depicted schematically in the drawings. FIG. 1 depicts an inventive coiled heat exchanger 1 for liquefying a stream of natural gas 2 into liquefied natural gas (LNG=liquefied natural gas) 3 by indirect heat exchange with three refrigerant streams, a low-pressure refrigerant 4, a first high-pressure refrigerant 5 and a second high-pressure refrigerant 6.

Figure 2:
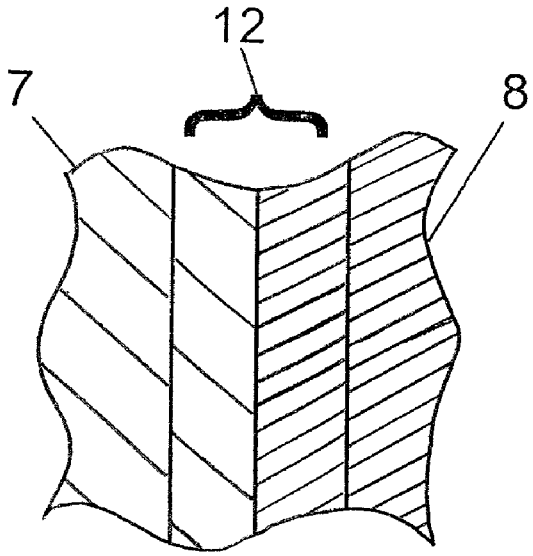
FIG. 2 is a schematic illustration of a connecting piece welded to first and second components of the heat exchanger.

The coiled heat exchanger in this case features a single tube bundle with three tube groups: The tubes in the tube groups are spirally wound on a common core tube in an alternating manner in different layers. (The tube coiling corresponds to the generally known principle of a coiled heat exchanger; as a result, the geometric arrangement is not depicted in the schematic drawing.) The tube groups in this example are divided by process streams. The natural gas 2 flows through the tubes of a first tube group 7; one of the two high-pressure refrigerants 5, 6 flows through each of the tubes of a second or third tube group 8, 9. The high-pressure refrigerants in this case are guided from the bottom to the top, i.e., in parallel flow with the natural gas. The low-pressure refrigerant 4 flows from the top to the bottom, i.e., in the opposite direction of flow of the natural gas, through the outer space of the tubes and is vaporized in the process. Vaporized low-pressure refrigerant 10 is withdrawn again from the outer space at the lower end of the heat exchanger. As noted previously, one group of tubes may be in a first tube layer and manufactured of aluminum, while another group of tubes may be in the same or another tube layer and comprised of steel. As shown in FIG. 2, a connecting piece 12 can be welded to both the first component (here, the tube group 7) as well as to the second component (here, the tube group 8).

In a concrete numerical example, the process pressures are as follows:

| | |
|---|---|
| Natural gas 2 | 120 bar |
| Low-pressure refrigerant 4 | 15 bar |
| First high-pressure refrigerant 5 | 60 bar |
| Second high-pressure refrigerant 6 | 60 bar |

The tubes are manufactured of a light metal material, for example aluminum or an aluminum alloy, and have different wall thicknesses depending on the tube group. In this case, the outer diameters of the tubes in all tube layers are the same.

The wall thicknesses are as follows in a first variant which was optimized in term of weight:

| | |
|---|---|
| Tube group 7 | 1.4 mm |
| Tube groups 8 and 9 | 0.9 mm |

In another variant, the wall thicknesses were optimized with respect to the thermal and hydraulic design and with respect to a tube bundle that is structured as homogenously as possible, wherein process-related parameters (e.g., predetermined maximum pressure drops in the individual process streams) were to be complied with. The wall thicknesses are as follows in this second variant:

| | |
|---|---|
| Tube group 7 | 1.4 mm |
| Tube groups 8 and 9 | 1.2 mm |

In the second variant, identical tube lengths were achieved in the individual tube groups, whereby the heat exchanger was optimized both in terms of heat transfer as well as in terms of economic efficiency.

In the exemplary embodiment, all tubes and the core tube are made of aluminum and the tube bases of stainless steel, which is aluminum-plated at the connecting points with the tubes.

The invention claimed is:

1. A coiled heat exchanger comprising:

a plurality of tubes wound around a core tube, and a casing that delimits an outer space around the tubes, wherein the plurality of tubes includes a first group of tubes and a second group of tubes, the tubes in the first and second groups being composed of different materials and connected by way of a connecting piece made of the same material as the first group of tubes as a basic material and a plating on the basic material that is made of the same material as the second group of tubes.

2. The heat exchanger according to claim 1, wherein one of the basic material and the plating is aluminum and the other of the basic material and the plating is steel.

3. The heat exchanger according to claim 1, wherein an indirect heat exchange between a hydrocarbonaceous stream in one of said first and second groups and at least one heat fluid or cold fluid in the other of said first and second groups is executed.

4. The heat exchanger according to claim 3, wherein the hydrocarbonaceous stream is formed by natural gas.

5. The heat exchanger according to claim 3, wherein the hydrocarbonaceous stream is liquefied, cooled, heated and/or vaporized during the indirect heat exchange.

6. A method of liquefying a stream of natural gas with a coiled heat exchanger according to claim 1, comprising:

flowing the stream of natural gas through the first group of tubes; and flowing a refrigerant through the second group of tubes.

7. The method according to claim 6, wherein a cross-section of a tube of the first group of tubes is different from a cross-section of a tube of the second group of tubes.

* * * * *